US011731675B2

(12) United States Patent
Oh et al.

(10) Patent No.: US 11,731,675 B2
(45) Date of Patent: Aug. 22, 2023

(54) EXCLUSIVE TRACK RESOURCE SHARING SYSTEM

(71) Applicant: Korea Railroad Research Institute, Uiwang-si (KR)

(72) Inventors: Seh Chan Oh, Gyeonggi-do (KR); Jong Hyen Baek, Seoul (KR); Hyeon Yeong Choi, Jeollabuk-do (KR); Byung Hun Lee, Gwangju (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 665 days.

(21) Appl. No.: 16/618,523

(22) PCT Filed: Dec. 11, 2018

(86) PCT No.: PCT/KR2018/015685
§ 371 (c)(1),
(2) Date: Dec. 2, 2019

(87) PCT Pub. No.: WO2020/101109
PCT Pub. Date: May 22, 2020

(65) Prior Publication Data

US 2021/0362757 A1 Nov. 25, 2021

(30) Foreign Application Priority Data

Nov. 16, 2018 (KR) ..... 10-2018-0141491

(51) Int. Cl.
*B61L 27/00* (2022.01)
*B61L 27/20* (2022.01)
(Continued)

(52) U.S. Cl.
CPC ..... *B61L 27/20* (2022.01); *B61B 1/02* (2013.01); *B61L 3/006* (2013.01); *B61L 3/008* (2013.01);
(Continued)

(58) Field of Classification Search
CPC ..... B61L 27/20; B61L 3/006; B61L 3/008; B61L 15/0027; B61L 15/0072;
(Continued)

(56) References Cited

U.S. PATENT DOCUMENTS 10,259,478 B1 * 4/2019 Gao ..... B61L 27/20
10,297,153 B2 * 5/2019 Gao ..... B61L 25/025
(Continued)

FOREIGN PATENT DOCUMENTS

CN 107284471 A 10/2017
JP 2002-362367 A 12/2002
(Continued)

OTHER PUBLICATIONS

International Search Report of PCT/KR2018/015685 dated Aug. 5, 2019 [PCT/ISA/210].
(Continued)

*Primary Examiner* — Zachary L Kuhfuss
(74) *Attorney, Agent, or Firm* — Sughrue Mion, PLLC

(57) ABSTRACT

A system for exclusive track resource sharing is provided. Some embodiments provide an exclusive track resource sharing system including onboard control units and a resource manager. Onboard control unit is provided in each of trains and is configured to communicate with another onboard control unit in another train. The resource manager is configured to record ownership status information of track resources of the plurality of trains, to provide the ownership status information of the track resources to the onboard control unit, and to generate and deliver a resource entitlement or resource authority to the onboard control unit. The resource authority is configured to be owned by a single onboard control unit. The onboard control unit possessing the resource authority is configured to seize or release the track resources corresponding to the resource authority and
(Continued)

to control the track resources corresponding to the resource authority.

22 Claims, 16 Drawing Sheets

(51) Int. Cl.

| | |
|---|---|
| ***B61L 15/00*** | (2006.01) |
| ***B61L 27/14*** | (2022.01) |
| ***B61L 27/53*** | (2022.01) |
| ***B61B 1/02*** | (2006.01) |
| ***B61L 27/04*** | (2006.01) |
| ***B61L 3/00*** | (2006.01) |
| ***B61L 23/00*** | (2006.01) |
| ***B61L 19/00*** | (2006.01) |
| ***B61L 23/14*** | (2006.01) |

(52) U.S. Cl.
CPC ..... *B61L 15/0027* (2013.01); *B61L 15/0072* (2013.01); *B61L 15/0081* (2013.01); *B61L 19/00* (2013.01); *B61L 23/005* (2013.01); *B61L 23/14* (2013.01); *B61L 27/04* (2013.01); *B61L 27/14* (2022.01); *B61L 27/53* (2022.01); *B61L 2027/204* (2022.01)

(58) Field of Classification Search
CPC .... B61L 15/0081; B61L 19/00; B61L 23/005; B61L 23/14; B61L 27/04; B61L 27/14; B61L 27/53; B61L 2027/204; B61L 27/00; B61B 1/02
See application file for complete search history.

(56) References Cited

U.S. PATENT DOCUMENTS

| | | | | |
|---|---|---|---|---|
| 10,875,559 | B2 * | 12/2020 | Gao | B61L 25/025 |
| 2004/0010432 | A1 | 1/2004 | Matheson et al. | |
| 2013/0325211 | A1 * | 12/2013 | El Fassi | B61L 13/04 701/2 |
| 2014/0131524 | A1 | 5/2014 | Grimm et al. | |
| 2019/0054940 | A1 * | 2/2019 | Gao | B61L 25/04 |
| 2019/0111953 | A1 * | 4/2019 | Gao | B61L 3/08 |
| 2019/0114914 | A1 * | 4/2019 | Gao | G08G 1/096822 |

FOREIGN PATENT DOCUMENTS

| | | | |
|---|---|---|---|
| JP | 2010-47102 | A | 3/2010 |
| JP | 2010-260518 | A | 11/2010 |
| JP | 2013-95293 | A | 5/2013 |
| JP | 2018-34570 | A | 3/2018 |
| JP | 2018-158607 | A | 10/2018 |
| KR | 10-2016-0071645 | A | 6/2016 |
| KR | 10-2018-0014290 | A | 2/2018 |
| WO | 2018/163509 | A1 | 9/2018 |

OTHER PUBLICATIONS

Communication dated Mar. 16, 2021 from the Japanese Patent Office in Application No. 2019-565900.
Office Action dated Jul. 9, 2020 in Korean Application No. 10-2018-0141491.

* cited by examiner

EXCLUSIVE TRACK RESOURCE SHARING SYSTEM

CROSS REFERENCE TO RELATED APPLICATIONS

This application is a National Stage of International Application No. PCT/KR2018/015685, filed Dec. 11, 2018, claiming priority to Korean Patent Application No. 10-2018-0141491, filed Nov. 16, 2018, the contents of all of which are incorporated herein by reference in their entirety.

TECHNICAL FIELD

The present disclosure in some embodiments relates to an exclusive track resource sharing system and method thereof. More particularly, the present disclosure relates to an exclusive track resource sharing system and method for autonomous train control based on inter-train communications.

BACKGROUND

The statements in this section merely provide background information related to the present disclosure and do not necessarily constitute prior art.

Conventional train control is accomplished by relying on one or more ground control systems on the route. The ground control systems have control over all or part of the route, and they serve to constitute a route for the train to run, switch the necessary tracks, and finally give the train the distance and speed limits based on the location of the train within the controlled boundary. Onboard control systems are adapted to control the train speed in consideration of the locomotion and braking performance of the train so as not to exceed the distance and speed limits provided by the ground control system.

The area of the route governed by the ground control system is considered to be a border, and trains need to be interfaced with multiple ground control systems in order to travel without stopping at many areas. The ground control system has a limited number of trains that it can accommodate within its government, and it is unavoidable to add a ground control system for governing a relevant route when extended or expanded to multiple routes. Such ground control systems reduce the flexibility of train operation and complicate the system configuration, resulting in an increase in facility construction costs. In addition, the cyclical information flow between the onboard control system and the ground control system degrades the performance of train control.

Therefore, there is a need for autonomous train control that enables the trains to autonomously calculate the limits of distance and speed required for the trains to travel based on wireless inter-train communications without the conventional ground control system. In order to realize the autonomous train control, management is needed for mutually exclusive sharing of track resources by multiple trains.

DISCLOSURE

Technical Problem

The present disclosure in some embodiments seeks to provide a system that can stably share the track resources for autonomous train control based on inter-train communications.

Further, the present disclosure in some embodiments aims to improve the train control performance by enabling trains to autonomously calculate the limits of the distance and speed required for the trains to run based on wireless communication between trains without the conventional ground control system, thereby improving the flexibility of train operation.

SUMMARY

At least one embodiment of the present disclosure provides a system for exclusive track resource sharing including an onboard control unit provided in each of a plurality of trains and a resource manager. The onboard control unit is configured to communicate with another onboard control unit in another one of the plurality of trains. The resource manager is configured to record ownership status information of track resources of the plurality of trains, to provide the ownership status information of the track resources to the onboard control unit, and to generate and deliver a resource authority to the onboard control unit. The resource authority is configured to be owned by a single onboard control unit. The onboard control unit possessing the resource authority is configured to seize or release the track resources corresponding to the resource authority and to control the track resources corresponding to the resource authority.

Advantageous Effects

As described above, according to some embodiments, the present disclosure has an effect of improving the train control performance by enabling the train to autonomously calculate its limits of distance and speed required for the train to run based on wireless train-to-train communications without the conventional ground control system.

REFERENCE NUMERALS

Figure 1:
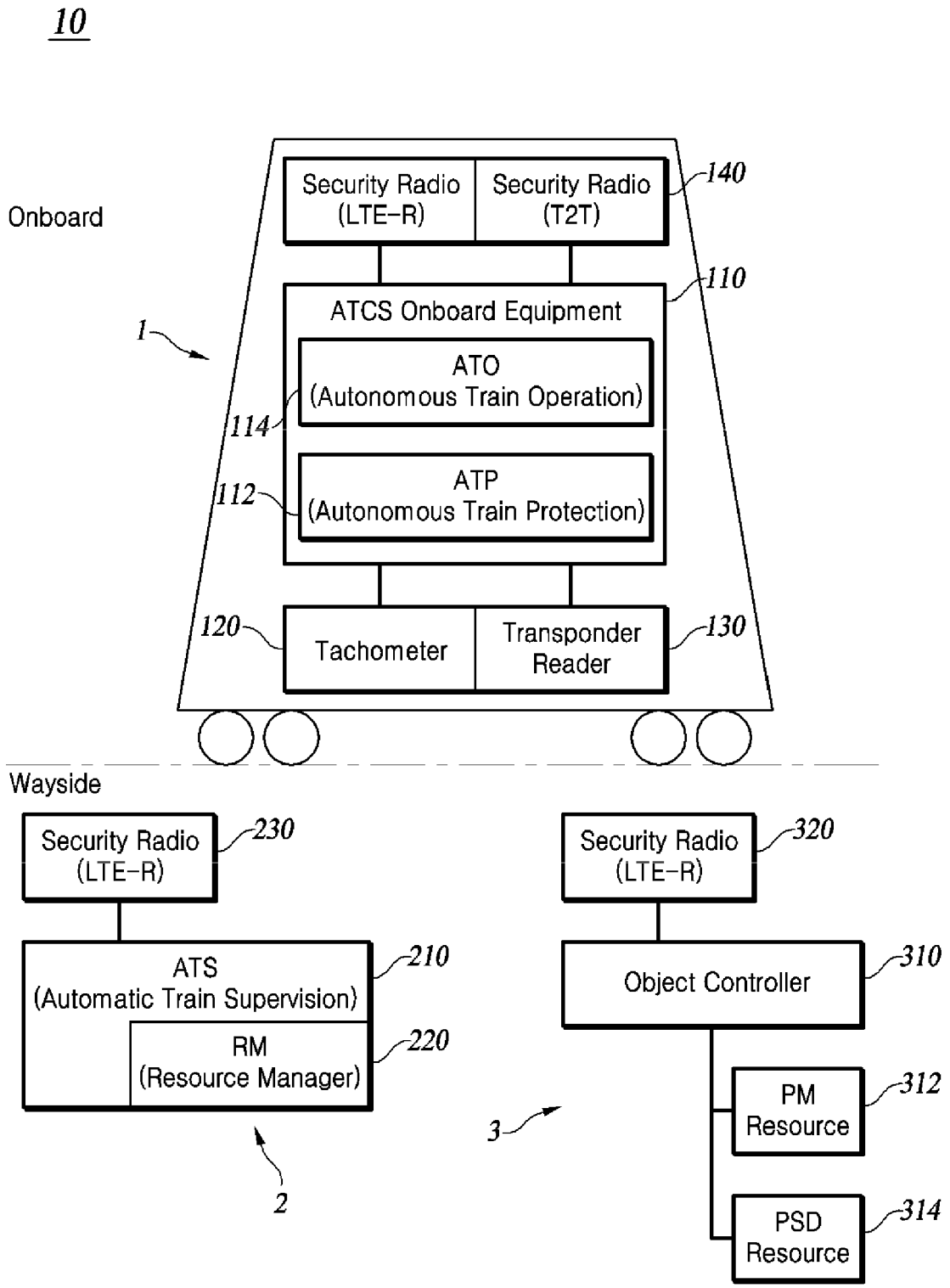
FIG. 1 is a diagram of a configuration of an exclusive track resource sharing system according to at least one embodiment of the present disclosure.

| | |
|---|---|
| 110: onboard control unit | |
| 210: automatic train supervision (ATS) unit | |
| 220: resource manager | 310: object controller (OC) |
| 312: point machine (PM) | 314: platform screen door (PSD) |
| 316: twin switch or twin point machine | |

DETAILED DESCRIPTION

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

Additionally, various terms such as first, second, i), ii), a), b), etc., are used solely for the purpose of differentiating one component from the other, not to imply or suggest the substances, the order or sequence of the components. Throughout this specification, when a part "includes" or "comprises" a component, the part is meant to further include other components, not to exclude thereof unless specifically stated to the contrary.

FIG. 1 is a diagram of a configuration of an exclusive track resource sharing system 10 according to at least one embodiment of the present disclosure.

As shown in FIG. 1, the exclusive track resource sharing system 10 includes an onboard system and a ground system.

The onboard system may include onboard control equipment or an onboard control unit 110, a tachometer 120, a transponder reader 130, and radio equipment or a radio communication apparatus 140.

The onboard control unit 110 is provided in each of a plurality of trains 1. Each onboard control unit 110 is configured to be capable of communicating with another onboard control unit 110.

The onboard control unit may include an autonomous train protection (ATP) unit 112 and an autonomous train operation (ATO) unit 114.

The tachometer 120 is configured to calculate the location of and distance traveled by the train 1, and the transponder reader 130 may be configured to identify the ID of a wayside coil on the track and to correct the location information of the train 1 derived by the tachometer 120.

The radio communication apparatus 140 is configured to support direct train-to-train communications (T2T communications) and communications between the train, a ground automatic train supervision (ATS) unit 210 and a ground resource manager (RM) 220 (T2W communications).

The ground system may include the ATS unit 210, a resource manager 220, and an object controller (OC) 310.

The ATS unit 210 is configured to monitor and control the trains on a route.

The resource manager 220 is configured to record ownership status information on track resources of the plurality of trains 1, and is configured to provide the onboard control unit 110 with the ownership status information on track resources.

The resource manager 220 is configured to generate and transfer a resource authority (RA) to the onboard control unit 110.

The resource authority is configured to be exclusively owned by a single onboard control unit 110. The onboard control unit 110 possessing the resource authority is configured to seize or release track resources corresponding to the resource authority and to control the track resources correspond to the resource authority.

The OC 310 may be configured to receive a control command over track resource from the resource manager 220 and to control the resources in the field.

The track resources may include one or more of a track, a point machine (PM), and a platform screen door (PSD).

The owners of the track resources may be the train 1 and the ATS unit 210. In embodiments, track resources may be separated into concepts of ownership and control.

The resource manager 220 manages the integrity and ownership of the track resources for the exclusive sharing of the track resources. Here, the integrity of the track resources means that it is in a safe state to allocate the track resources to the owner.

For example, the resource manager 220 does not allocate a relevant track resource to the train 1 when there is a defect in a track, PM or PSD or a protection zone is set on the track.

A temporary speed limit zone may be configured to be set or released by the ATS unit 210 or the onboard control unit 110 of the train 1.

The protection zone may be set by the ATS unit 210 or the onboard control unit 110 of the train 1, and the protection zone is released by the ATS unit 210 only in a configuration of some embodiments.

In a configuration of some embodiments, the temporary speed limit zone is set or released even without securing the resource authority corresponding to the relevant track, but the protection zone is set or released only after securing the resource authority.

The control of the relevant track resources by the PM and the PSD may also be configured to be available after securing the resource authority corresponding to the relevant track resources.

Figure 2:
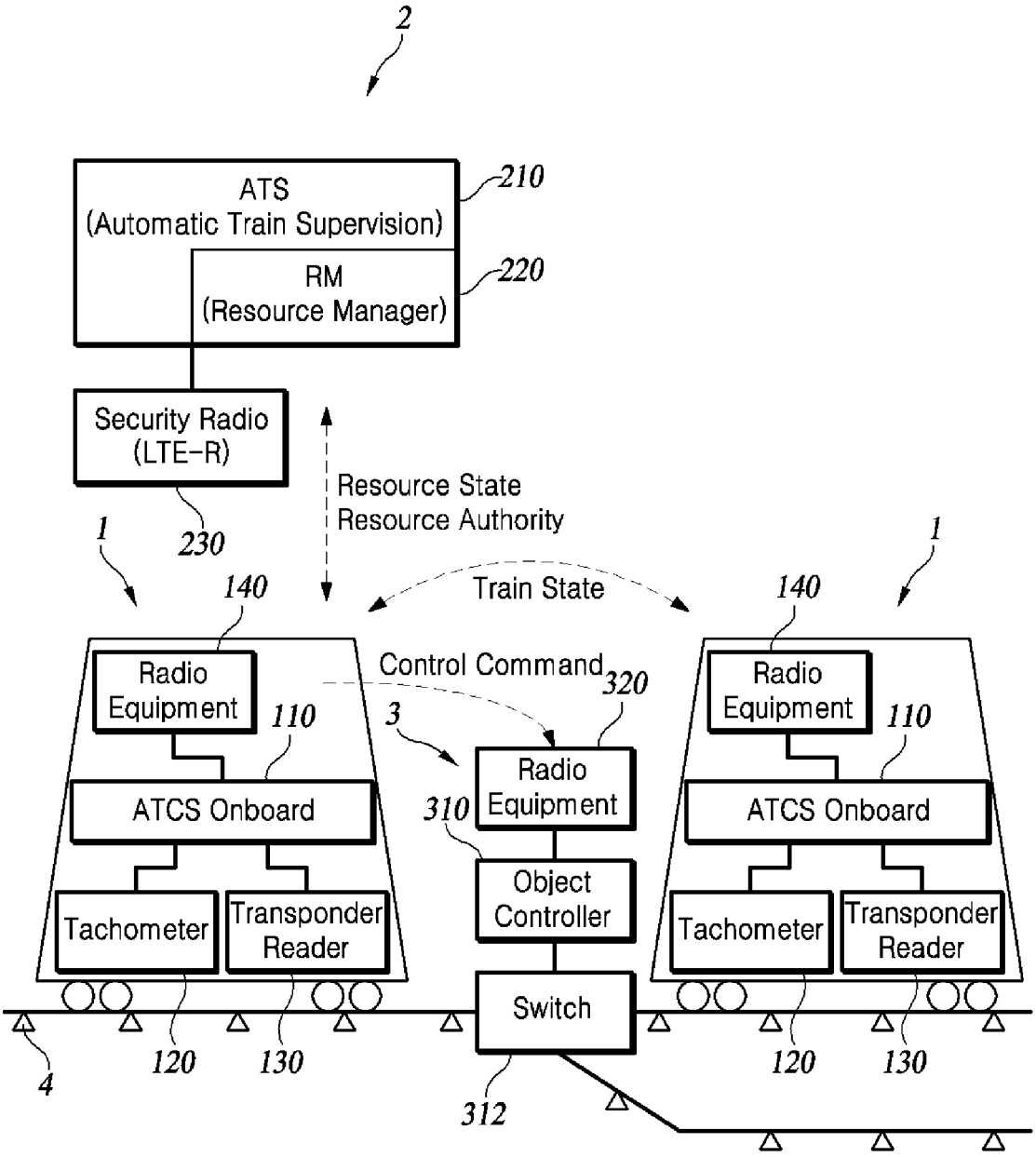
FIG. 2 is a diagram illustrating an example control flow of an exclusive track resource sharing system according to at least one embodiment of the present disclosure.

FIG. 2 is a diagram illustrating an example control flow of the exclusive track resource sharing system 10 according to at least one embodiment of the present disclosure.

As shown in FIG. 2, the resource manager 220 is configured to manage ownership of track resources of a route.

The resource manager 220 provides track information and the resource authority (RA) needed for calculating the limit of distance required for the train 1 to run.

The train 1 may receive information on the state of the preceding train, e.g., the speed, acceleration, location, etc. of the preceding train through communication between the onboard control units 120, and may obtain the resource authority through the resource manager 220, which needs to be secured for the subject train to run.

The resource manager 220 is configured to monitor the integrity of all track resources of the route, that is, whether the track resources are defective. In particular, the resource manager 220 may determine whether the track resources are in an allocatable state when they are requested.

The resource manager 220 may be configured to convert the track resources into an unallocatable state upon detecting that specific track resources (specific track zone, point machine, and PSD) are defective.

For example, upon receiving a request for the track resource occupying or seizing status from the onboard control unit 110, the resource manager 220 may manage an unallocatable track resource after marking the same as being excluded or unallocatable when providing the seizing status.

The resource manager 220 may be configured to reject an allocation request received for the track resources in an unallocatable state from the train 1.

Figure 3:
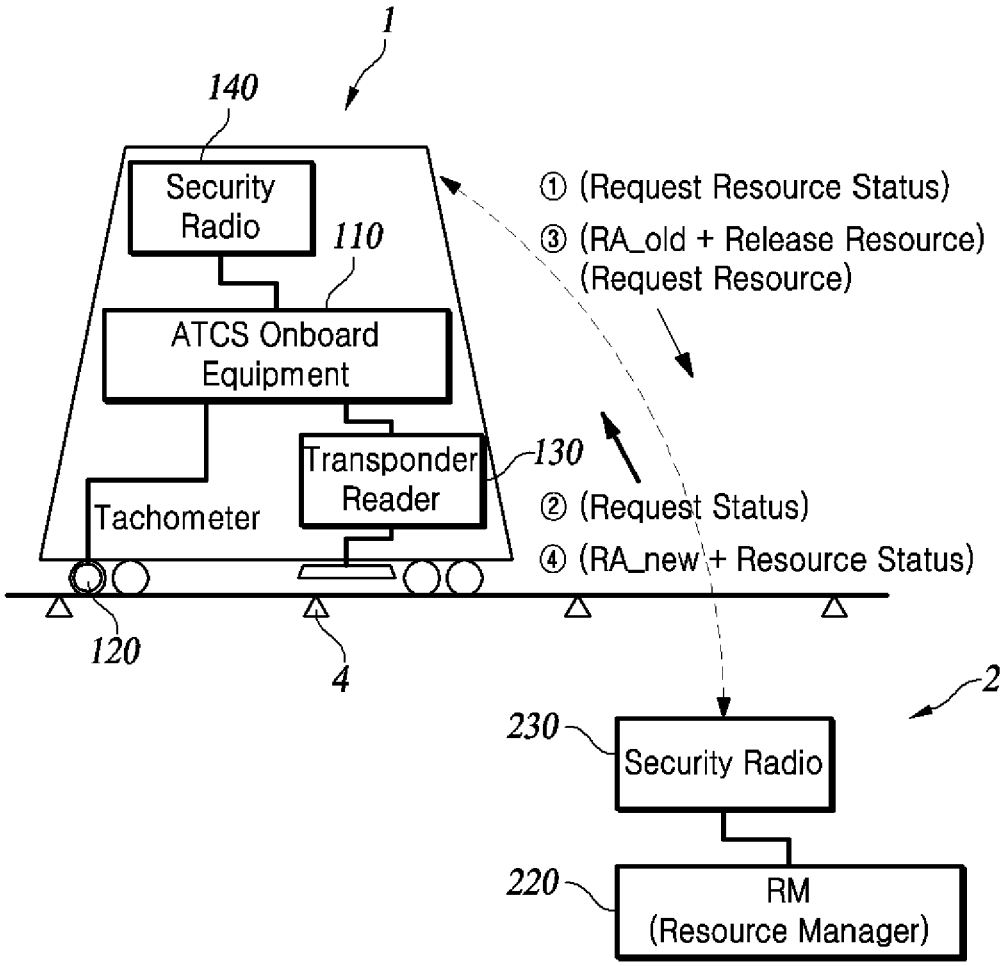
FIG. 3 is a diagram illustrating an example message flow for seizing track resources in an exclusive track resource sharing system according to at least one embodiment of the present disclosure.

FIG. 3 is a diagram illustrating an example message flow for seizing track resources in the exclusive track resource sharing system 10 according to at least one embodiment of the present disclosure.

As shown in FIG. 3, the onboard control unit 110 may be configured to request the resource manager 220 for the ownership status information on the track resources for the scheduled travel zone having a predetermined length in front of the subject train.

The resource manager 220 provides ownership status information about the track resources for the zone requested by the onboard control unit 110.

The onboard control unit 110 is configured to thereafter request the resource manager 220 to release the track resources used by the subject train by using the resource authority it owns, and at the same time, to use the ownership status information on the track resources as a basis for requesting a resource authority corresponding to the track resources required for the subject train to run.

The resource manager 220 may be configured to be responsive to another onboard control unit 110 in another train or the ATS unit 210 seizing at least some of the track resources of the scheduled travel zone, for which the onboard control unit 110 has made a request, for providing the onboard control unit 110 with a resource authority corresponding to the track resources except for a track resource area within the track resources of the scheduled travel zone, for which the onboard control unit 110 has made the request, or for rejecting the request for the track resources of the scheduled travel zone.

The resource manager 220 may provide the onboard control unit 110 with ownership status information on track resources and may generate and provide a resource authority corresponding to the track resources requested by the onboard control unit 110.

Figure 4:
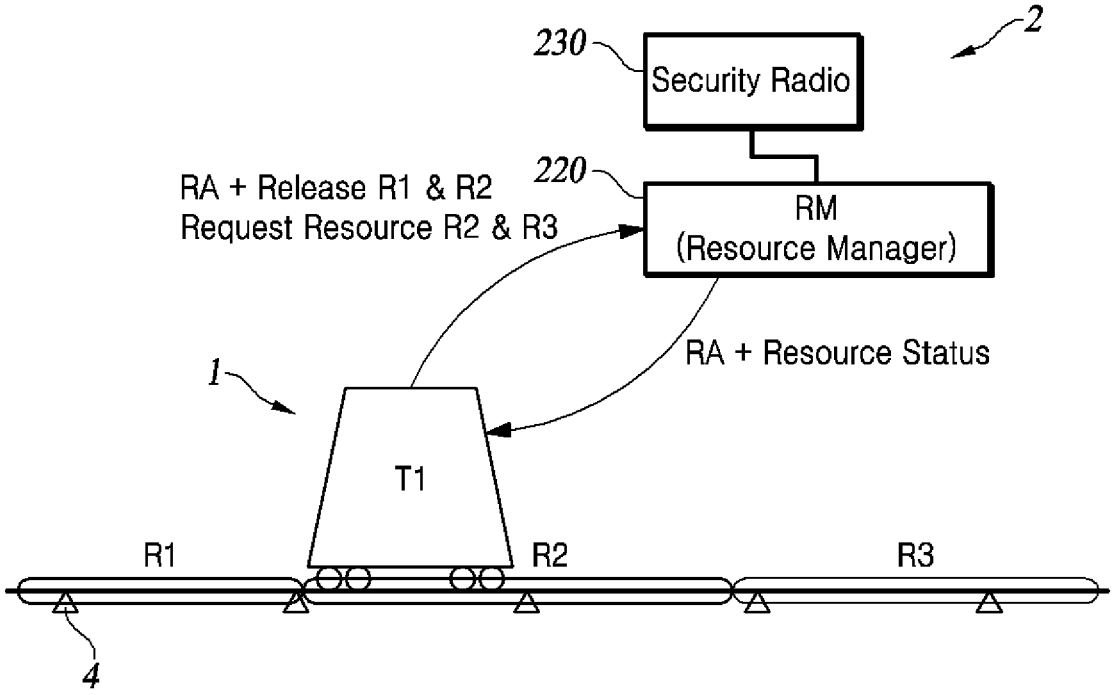
FIG. 4 is a diagram illustrating the release of track resources and the request for track resources according to at least one embodiment of the present disclosure.

FIG. 4 is a diagram illustrating the release of track resources and the request for track resources according to at least one embodiment of the present disclosure.

As shown in FIG. 4, when train 1 'T1' in possession of track resources R1 and R2 needs to return track resource R1 and newly secure track resource R3, it may utilize the resource authority previously secured through the resource manager 220 in order to release track resources R1 and R2 and to be granted a new resource authority for resources including track resources R2 and R3.

The onboard control unit 110 may be configured to forward the resource manager 220 with the release and securing of resources in one message. This can prevent the request of the other train from being inserted between the release of the used track resource and the securing of a new track resource.

Meanwhile, the resource manager 220 may be configured to grant a new resource authority whenever there is a request for track resources.

Resource authority granted to the track resource owner means a unique key value. Resource authority needs to be generated so that it does not overlap with another resource authority, and for this purpose, it needs to have value long enough.

Therefore, the resource manager 220 preferably applies a one-way function, such as a hash function, to generate a resource authority.

Upon receiving the release request, the resource manager 220 may be configured to check whether it has a value that matches the resource authority value corresponding to the relevant track resource, and only if so, to switch the relevant track resource to the unseized state. Here, the unseized state means a state that the relevant track resource can be allocated upon request for the same from the onboard control unit 110 or the ATS unit 210.

Figure 5:
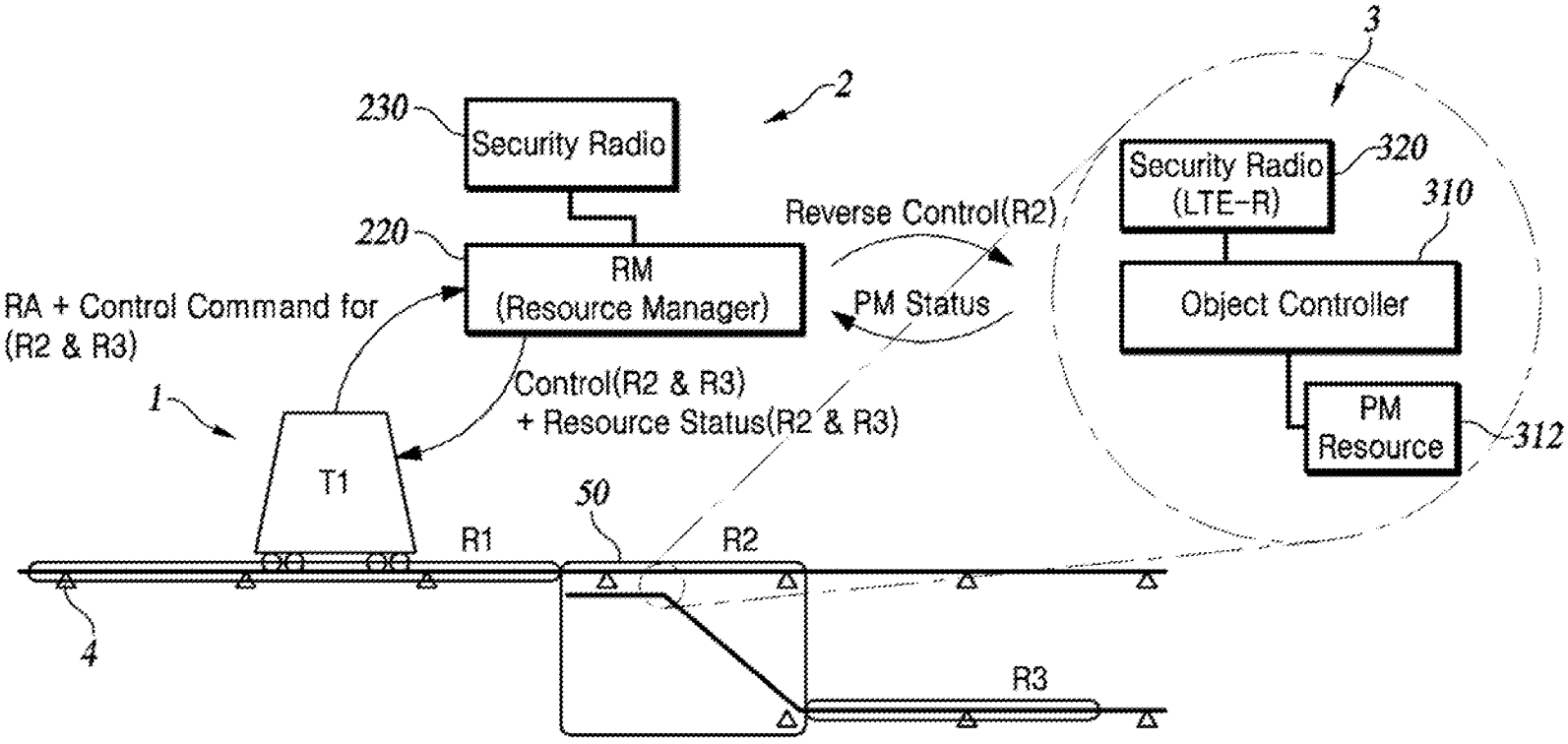
FIG. 5 is a diagram illustrating a track resource control through a resource manager according to at least one embodiment of the present disclosure.

FIG. 5 is a diagram illustrating a track resource control through the resource manager 220 according to at least one embodiment of the present disclosure.

As shown in FIG. 5, the OC 310 may be configured to control the PM 312 or the PSD 314 corresponding to the resource authority that the onboard control unit 110 owns.

The onboard control unit 110 may be configured to transmit a control command to the resource manager 220 for switching the PM 312 to a nominal position or a reverse position or switching the PSD 314 to the open state or the closed state.

The resource manager 220 may be configured to utilize the control command received from the onboard control unit 110 as a basis for transmitting to the OC 310 a control command for switching the PM 312 to the nominal position or the reverse position or switching the PSD 314 to the open state or the closed state. This will be described with reference to the embodiment shown in FIG. 5 as an example.

Train 1 'T1' has track resources R1, R2, and R3, and is illustrated as having resource authorities corresponding to the respective track resources.

The onboard control unit 110 of train 1 'T1' may transmit a control command to the resource manager 220 using the resource authority to control the already secured track resources R2 and R3. Here, track resource R2 is illustrated as including a track switch zone of the PM and the track.

The onboard control unit 110 of train 1 'T1' may transmit to the resource manager 220 a command for switching track resource R2 to the reverse position and may transmit a temporary speed limit zone setting command to track resource R3.

At this time, the resource manager 220 may confirm that the resource authority received from the onboard control unit 110 of train 1 'T1' is a valid resource authority, and it may then transmit to the onboard control unit 110 of train 1 'T1', the result of complete controlling of the relevant track resource, that is, the state of the relevant track resource.

About track resource R2, the resource manager 220 may transmit a command for switching the relevant PM 312 to the reverse position to the OC 310 configured to control the PM 312, and may relay the switching result received from the OC 310 to the onboard control unit 110 of 1 'T1'.

About track resource R3, the resource manager 220 writes the temporary speed limit zone in the track DB within the resource manager 220 for allowing the onboard control unit 110 of another train or the ATS unit 210 to recognize the same.

The onboard control unit 110 of train 1 'T1' may check the status of the track resources and update the movement authority (MA) of train 1 'T1' to the point where the control of the track resources is completed.

Figure 6:
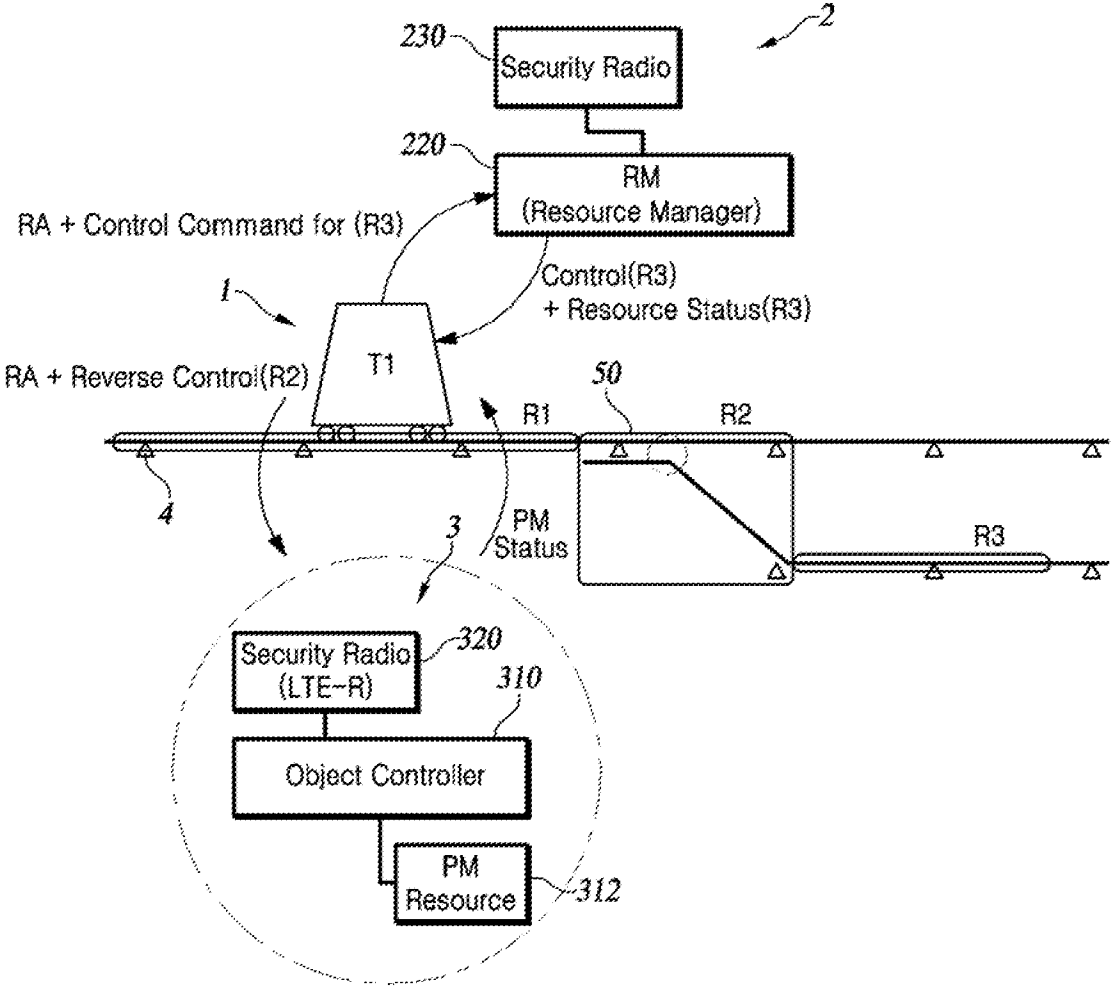
FIG. 6 is a diagram illustrating direct track resource control using a resource authority according to at least one embodiment of the present disclosure.

FIG. 6 is a diagram illustrating direct track resource control using a resource authority according to at least one embodiment of the present disclosure.

As shown in FIG. 6, the OC 310 may be configured to control the PM 312 or the PSD 314 corresponding to the resource authority that the onboard control unit 110 owns.

The onboard control unit 110 may be configured to transmit a control command to the OC 310 for switching the PM 312 to the nominal position or the reverse position or switching the PSD 314 to the open state or the closed state. The OC 310 may be configured to utilize the control command received from the onboard control unit 110 as the basis for switching the PM 312 to the nominal position or the reverse position or switching the PSD 314 to the open state or the closed state. This will be described with reference to the embodiment shown in FIG. 6 as an example.

The on-onboard control unit 110 of train 1 'T1' may switch the PM 312 corresponding to R2 among track resources R1, R2, and R3 owned by train 1 'T1' into the reverse position, and may set a temporary speed limit zone for track resource R3.

The onboard control unit 110 of train 1 'T1' may utilize the resource authority corresponding to track resources R1, R2, and R3 for setting the temporary speed limit zone, through the resource manager 220, to the track zone of track resource R3.

In addition, the on-onboard control unit 110 of train 1 'T1' may command the OC 310 configured to control the PM 312 corresponding to track resource R2 to utilize the resource authority owned by train 1 'T1' for switching the PM 312 into the reverse position. At this time, the OC 310 may check whether it is a valid resource authority.

Upon confirming the effective resource authority, the OC 310 may switch the PM 312 to the reverse position and transmit the result back to the onboard control unit 110 of train 1 'T1'.

The direct control of the onboard control unit 110 over the PM 312 and the PSD 314 excluding the track among the track resources will desirably lessen the duty of the resource manager 220.

In this case, whenever the resource manager 220 grants a new resource authority for the PM 312 and the PSD 314, the resource authority inside the OC 310 also needs to be updated. The detailed description in this regard is given in the description of FIG. 7.

Figure 7:
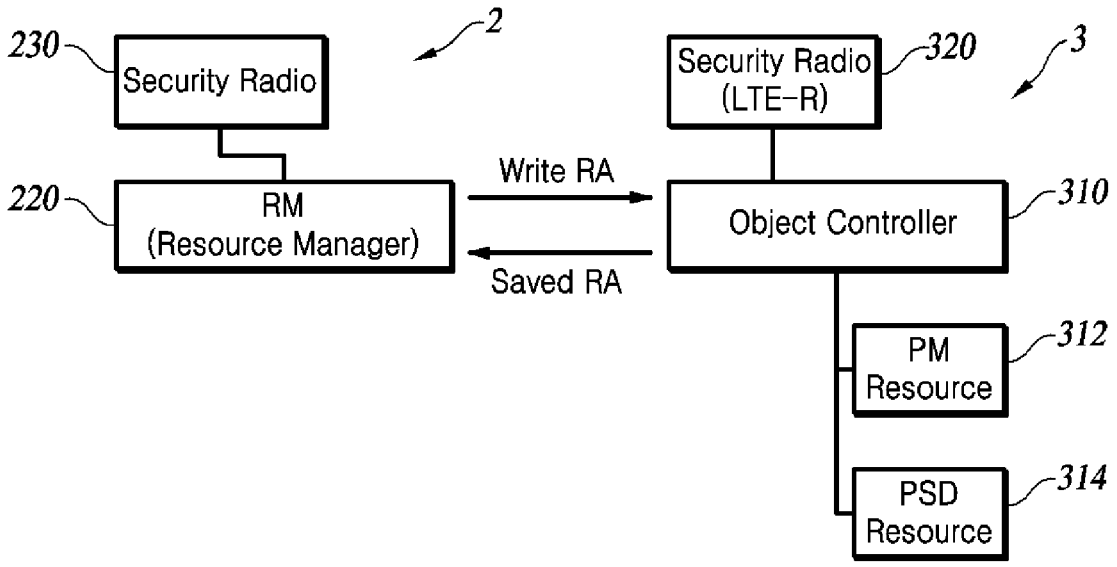
FIG. 7 is a block diagram illustrating updating a resource authority between a resource manager and an object controller (OC) according to at least one embodiment of the present disclosure.

FIG. 7 is a block diagram illustrating updating a resource authority between the resource manager 220 and the OC 310 according to at least one embodiment of the present disclosure.

As shown in FIG. 7, the resource manager 220 may be configured to update a resource authority corresponding to the PM 312 or PSD 314 upon receiving a request for the track resource including the PM or the PSD from the onboard control unit 110, and to deliver the resource authority corresponding to the updated PM or PSD to the OC 310.

The OC 310 may be configured to notify the writing of the updated resource authority having been completed faultlessly by providing the resource manager 220 with the updated resource authority.

Figure 8A:
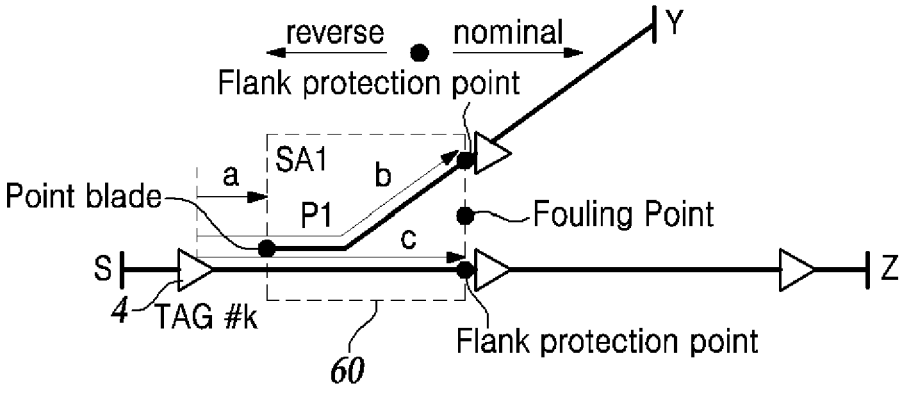
FIGS. 8A and 8B are diagrams illustrating a single switch or single point machine and a twin switch or twin point machine, respectively according to at least one embodiment of the present disclosure.
Figure 8B:
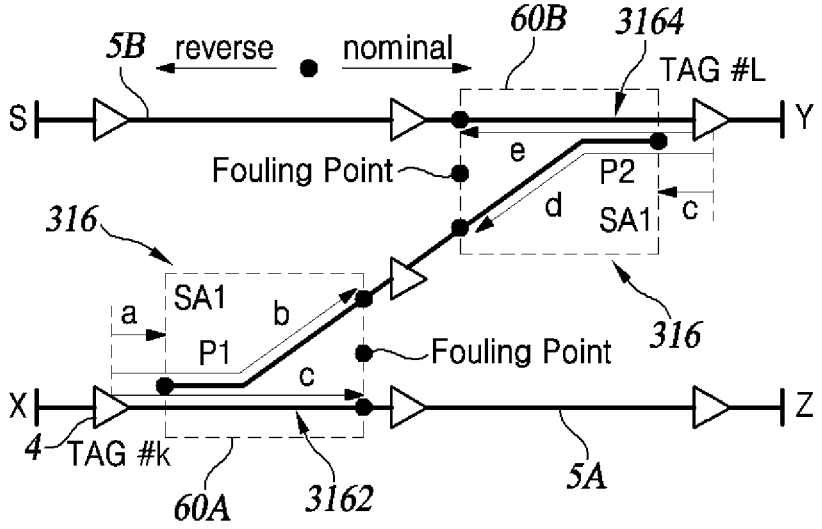

FIGS. 8A and 8B are diagrams illustrating a single switch or single point machine and a twin switch or twin point machine 316, respectively according to at least one embodiment of the present disclosure. Specifically, FIG. 8A is the single PM, and FIG. 8B is the twin PM 316.

As shown in FIGS. 8A and 8B, the track may have a track switch zone 60 which is configured to have a minimum semaphore area in consideration of the fouling point.

In the present disclosure, securing the point machine (PM) 312 by the rail 1 refers to securing the PM track switch zone 60.

As shown in FIG. 8A, the PM track switch zone 60 may be expressed with reference to a wayside coil (tag/balise) 4 by directions (nominal/reverse) and a start point and by the lengths of the track switch zone as measured in the normal direction and the reverse direction, respectively.

As shown in FIG. 8B, the twin PM 316 may include a first PM 3162 provided at a first track 5A and a second PM 3164 provided at a second track 5B adjacent to the first track 5A.

The first PM 3316 and the second PM 3164 may be configured to have their respective corresponding resource authorities. In other words, the track switch zones formed by the respective PMs 3162 and 3164 of the twin PM 316 may be independently seized and controlled.

For example, the onboard control unit 110 may be configured to control the first PM 3162 when provided with the resource authority corresponding to the first PM 3162, and to control the second PM 3164 when provided with the resource authority corresponding to the second PM 3164.

Figure 9:
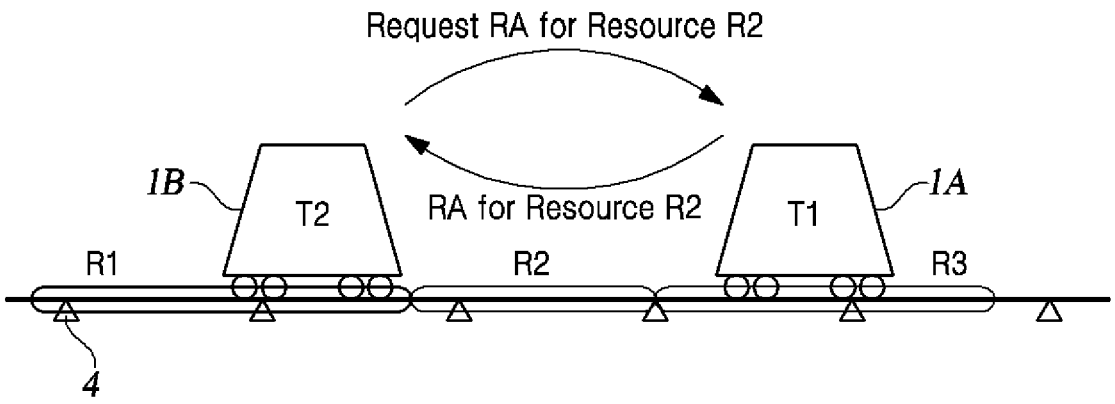
FIG. 9 is a diagram illustrating the transfer of a resource authority between trains according to at least one embodiment of the present disclosure.

FIG. 9 is a diagram illustrating the transfer of a resource authority between trains according to at least one embodiment of the present disclosure.

As shown in FIG. 9, the onboard control unit 110 may include a first onboard control unit provided in a first train 1A and a second onboard control unit provided in a second train 1B.

The first onboard control unit may be configured to transfer the first resource authority it owns to the second onboard control unit.

The second secondary control device that has received the first resource authority may be configured to seize or release the track resource corresponding to the first resource authority.

Transfer of track resources may be made directly between the track resource owners without passing through the resource manager 220. Here, the transfer of track resources means a transfer of the resource authority corresponding to the relevant track resources.

According to the example shown in FIG. 9, the first train 1A owns track resources R2 and R3, and the second train 1B owns track resource R1.

The second train 1B can recognize track resource R2 being owned by the first onboard control unit of the first train 1A through direct communication with the first train 1A.

The second train 1B may directly request the first train 1A for the resource authority of track resource R2. In this case, the first train 1A may transfer the resource authority corresponding to track resource R2 to the first train 1B after confirming that track resource R2 is in a transferable state, that is, a state in which it already finished using the same.

This allows the second train 1B to directly take over the track resource released by the first train 1A. In particular, the first train 1A may be configured to provide the second train 1B with the resource authority for track resource R2 while securing a new track resource and to update the resource authority corresponding to track resource R3.

In general, exclusive sharing of track resources may be achieved through the resource manager 220. For example, the exclusive track resource sharing may be carried out in such a way that the train 1 returns the completely used track resource to the resource manager 220 and a second request for a track resource is followed by an allocation of that track resource.

When the interval is narrowed between the preceding train and the following train, the latter can check the track resources returned by the preceding train through the resource manager 220 and make a second request to the resource manager 220 for the resource authority for the corresponding track resource, which, however, may be an inefficient procedure.

In addition, the ATS unit 210 may directly request the track resources owned by the train in danger for quick response in an exceptional circumstance. When the relevant train releases the track resources through the resource manager 220, another train may own the resources released in the meantime, which may cause another dangerous situation.

Transfer of track resources between the owners according to some embodiments of the present disclosure can prevent the track resources returned to the resource manager 220 from being allocated to a third track resource owner, thereby achieving efficient track resource allocation and preventing any additional risk situations.

Figure 10:
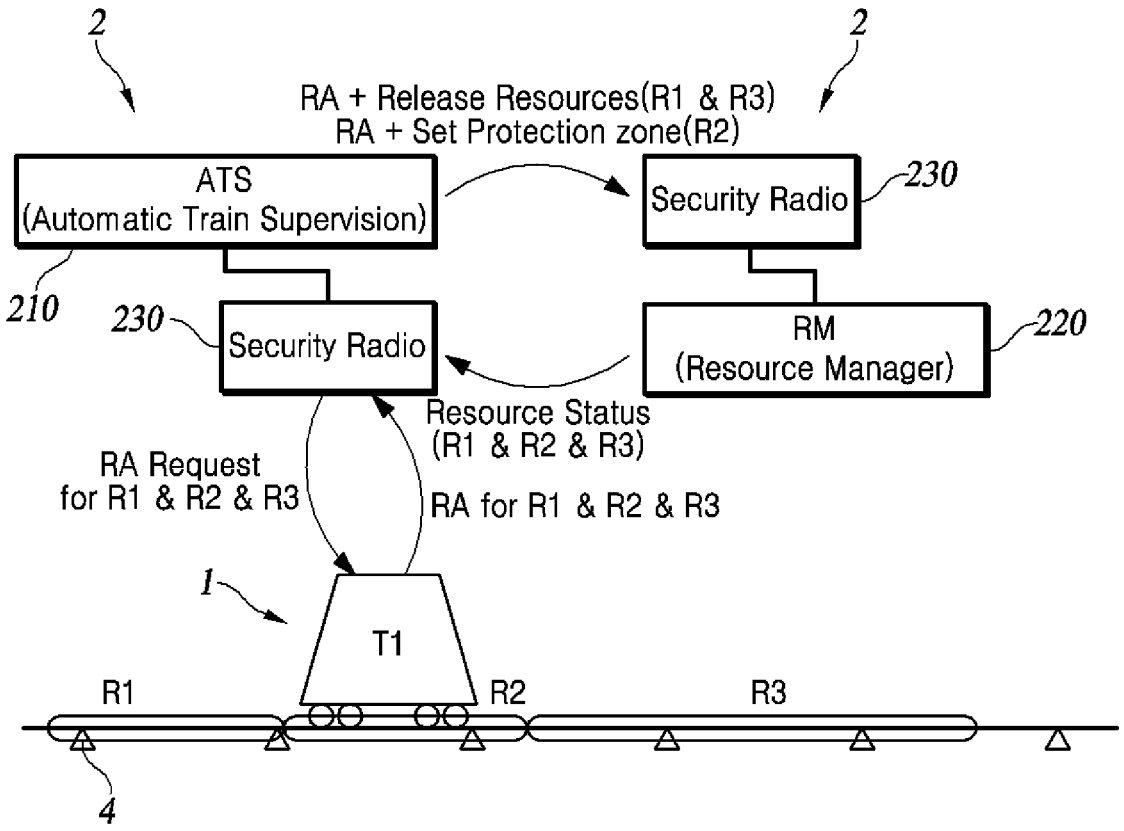
FIG. 10 is a diagram illustrating a response to a failure situation of a train according to at least one embodiment of the present disclosure.

FIG. 10 is a diagram illustrating a response to a failure situation of a train according to at least one embodiment of the present disclosure.

FIG. 10 illustrates that the train owning the track resources is in an emergency stop due to a failure, but the onboard control unit 110 within is normal.

The onboard control unit 110 may recognize that the normal operation of the train 1 unavailable due to the failure thereof and report the state of the train to the ATS unit 210. The ATS unit 210 may request the onboard control unit 110 of the train for the track resources possessed by that train.

The ATS unit 210 may release the remaining track resources R1 and R3 except track resource R2 corresponding to the zone occupied by the train among the track resources through the resource manager 220 and set a protection zone on track resource R2.

Figure 11:
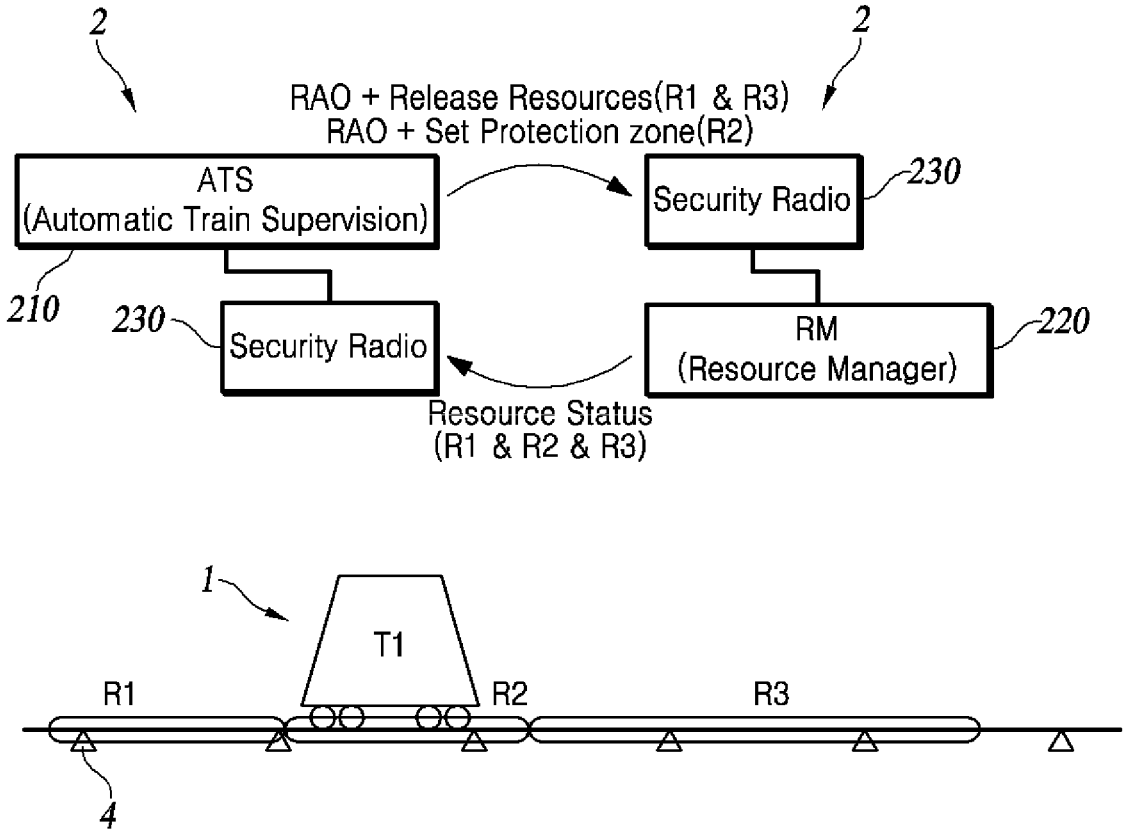
FIG. 11 is a diagram illustrating a response to a failure situation of an onboard control unit according to at least one embodiment of the present disclosure.

FIG. 11 is a diagram illustrating a response to a failure situation of an onboard control unit according to at least one embodiment of the present disclosure.

FIG. 11 illustrates that the onboard control unit 110 has failed as the train owning the track resources is in an emergency stop due to a failure.

In this case, since the onboard control unit 110 has failed, there is no way to check the resource authority for the track resource owned by the train 1 anymore.

The track resources owned by the relevant train 1 are written as the seized track resources on the resource manager 220. Accordingly, no train can enter such track resource zone.

The ATS unit 210 may, under the supervision operator's responsibility, generate a special resource authority (RA override or RAO), that is, a key such as a universal key for allowing to forcibly own or control the corresponding track resource.

In other words, the ATS unit 210 may be configured to seize or release all track resources by using a special resource authority, and thereby control all track resources.

All resource managers 220 and OCs 310 may be designed to operate when there is an advance input of a general resource authority (RA) or a special resource authority (RAO).

The ATS unit 210 may confirm that the onboard control unit 110 of the train 1 has failed, and utilize the special resource authority for releasing the remaining track resources R1 and R3 except for track resource R2 that the relevant train 1 owns and setting track resource R2 as being in the protection zone.

When a failure occurs in the OC 310, the resource manager 220 manages an area corresponding to that OC 310 as being unallocatable. When the corresponding area to the OC 310 is allocated to the onboard control unit 110 of the train 1, the onboard control unit 110 may set the remaining zone except for the corresponding area to the OC 310 as being under the movement authority of the train 1.

When the OC 310 is recovered to normal conditions, the resource manager 220 may first check such OC 310 and then manage the area of the OC 310 as being allocatable. With the train 1 owning the corresponding area to the OC 310, the onboard control unit 110 may set the zone inclusive of the corresponding area to the OC 310 as being under the movement authority of the train 1.

Figure 12:
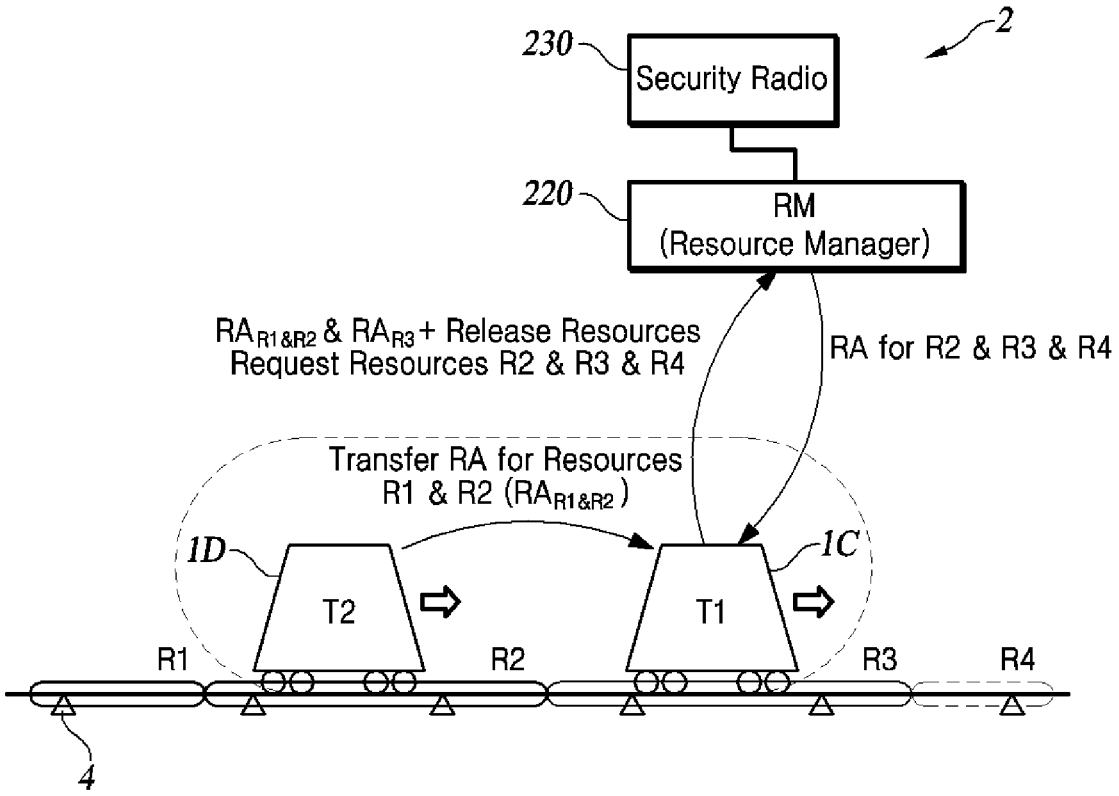
FIG. 12 is a diagram illustrating track resource management with two trains as being coupled according to at least one embodiment of the present disclosure.

FIG. 12 is a diagram illustrating track resource management with two trains as being coupled according to at least one embodiment of the present disclosure.

Figure 13:
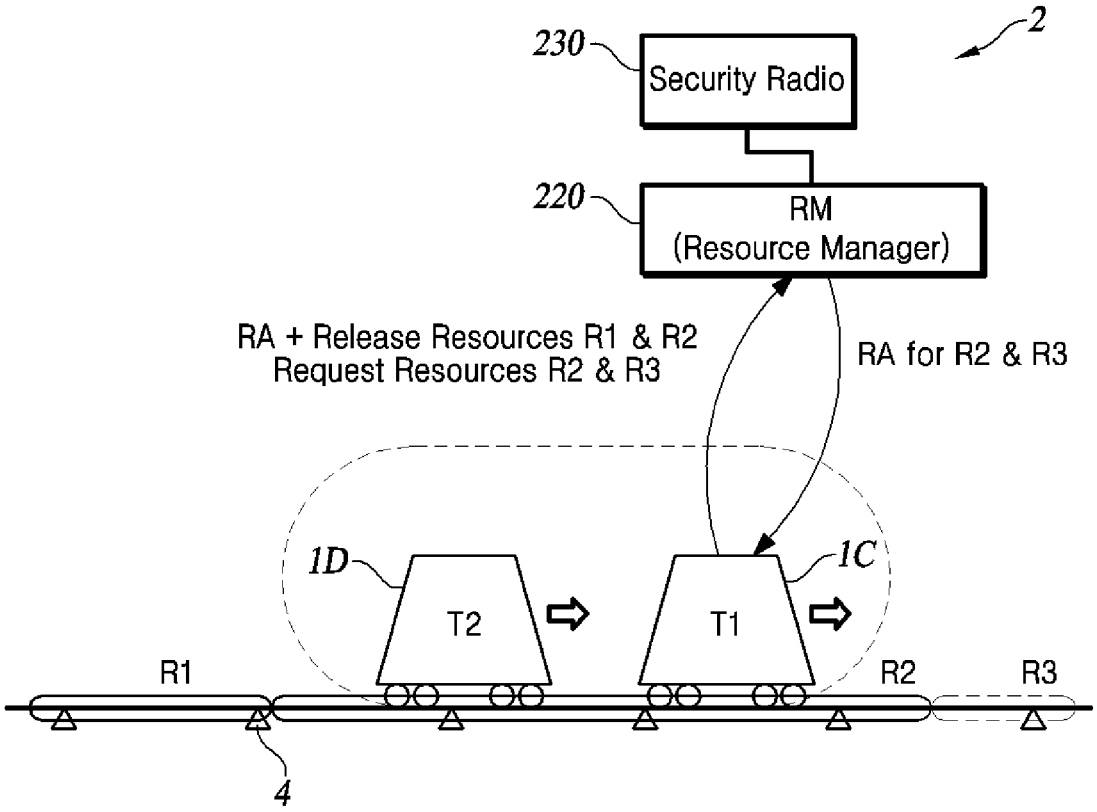
FIG. 13 is a diagram illustrating seizing and releasing of track resources in two intercoupled trains according to at least one embodiment of the present disclosure.

FIG. 13 illustrates seizing and releasing of track resources in two intercoupled trains according to at least one embodiment of the present disclosure.

The exclusive track resource sharing system 10 according to at least one embodiment of the present disclosure is capable of a complete moving block and an interval control beyond a moving block.

Here, the complete moving block means setting the movement authority of a trailing train so that the trailing train does not intrude on the protection area assigned to the preceding train. The interval control beyond moving block means to narrow the interval of the trailing train between the preceding train as close as or closer than the braking distance of the trailing train.

As shown in FIG. 12, two trains T1 and T2 may be coupled while running through the interval control beyond a moving block.

Train T1 '1C' has a track resource R3, and train T2 '1D' has track resources R1 and R2.

With train T1 (1C) and train T2 (1D) running in close proximity to each other for coupling, the onboard control unit of train T2 '1D' may transfer, at the moment of the intercoupling, the resource authority corresponding to the track resources R1 and R2 it owns to the onboard control unit of train T1 '1C'.

Thereafter, as shown in FIG. 13, train T2 '1D' no longer secures or releases track resources through the resource manager 220. The onboard control unit of train T1 '1C' may be configured to recognize the length of train T1 '1C' inclusive of the rear portion of train T2 '1D' at the moment of the intercoupling.

The onboard control unit of train T1 '1C' may perform a track resource return and a track resource request with the resource manager 220 by using the received resource authority corresponding to track resources R1 and R2 transferred from the onboard control unit of train T2 'D'.

For example, the onboard control unit of train T1 '1C' may release track resources R1, R2, and R3 and request a resource authority corresponding to track resources R2, R3, and R4 which is a new track resource to be secured.

After the intercoupling, the onboard control unit of train T1 '1C' may serve to release the track resources used by train T2 'D' on behalf of the onboard control unit of train T2 '1D' and return those track resources to the resource manager 220.

In addition, after the intercoupling, the onboard control unit of train T1 '1C' may be configured to request the resource manager 220 for the resource authority corresponding to the track resources required for trains T1 '1C' and T2 '1D' to run.

Figure 14:
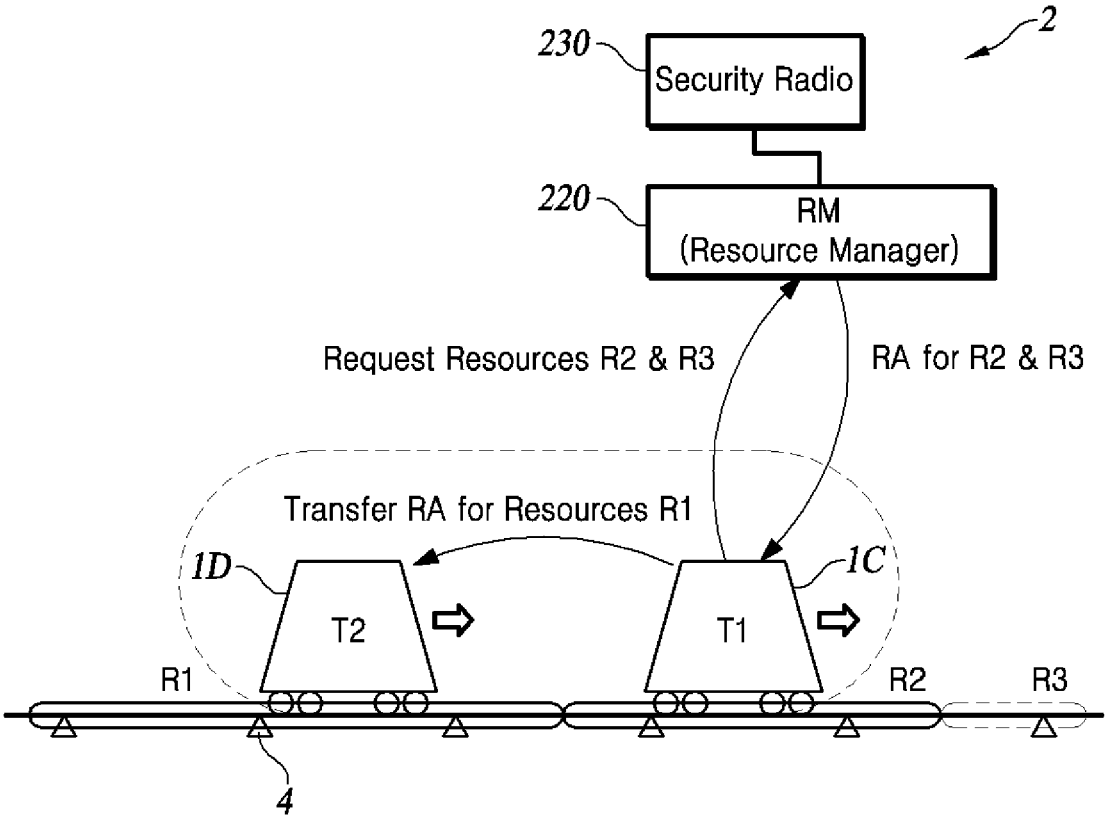
FIG. 14 is a diagram illustrating track resource management immediately before the separation between two coupled trains according to at least one embodiment of the present disclosure.

FIG. 14 is a diagram illustrating track resource management immediately before the separation between two coupled trains according to at least one embodiment of the present disclosure.

Figure 15:
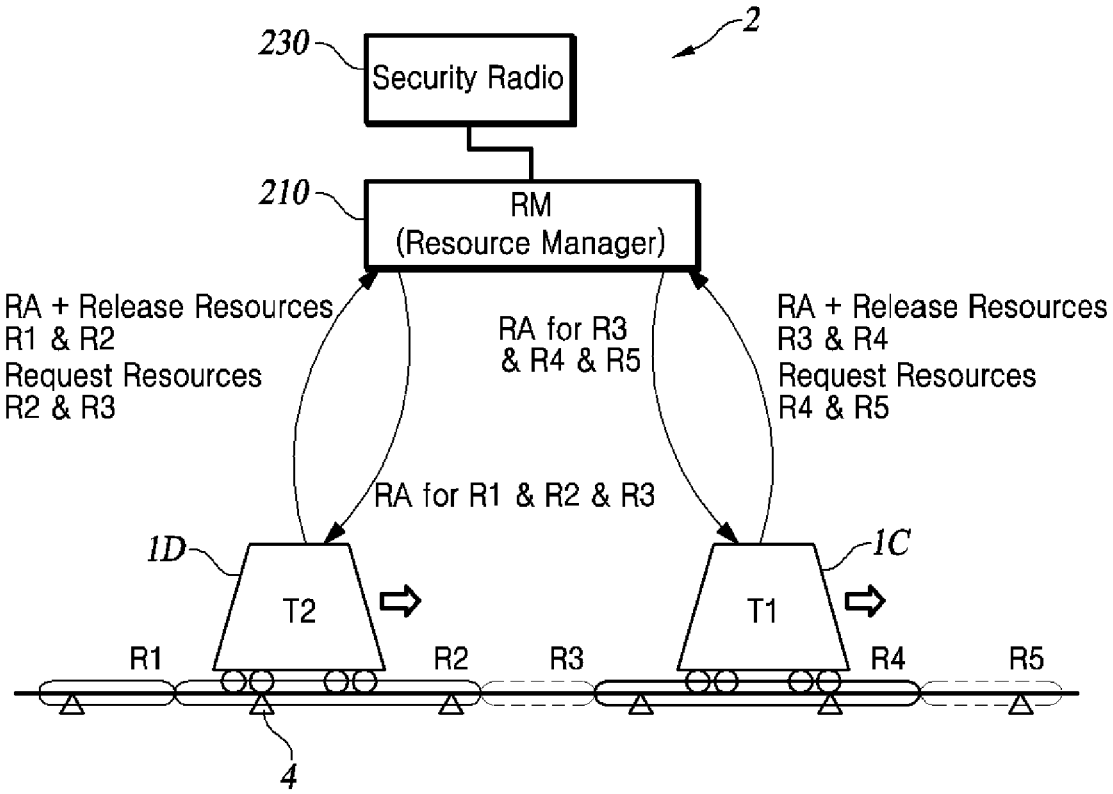
FIG. 15 illustrates seizing and releasing of track resources after two coupled trains are separated according to at least one embodiment of the present disclosure.

FIG. 15 illustrates seizing and releasing of track resources after two coupled trains are separated according to at least one embodiment of the present disclosure.

As shown in FIG. 14, two trains may be arranged to secure sufficient space for separation of the intercoupled trains. The onboard control unit of train T1 '1C' may be configured to recognize, immediately before separation, the train length excluding train T2 '1D' as its own train length, and to transfer to the onboard control unit of train T2 '1D', the resource authority corresponding to track resource R1 required for train T2 '1D' to run.

The onboard control unit of train T1 may transfer the resource authority corresponding to track resource R1 (at this point, track resources R1 and R2 take the same resource authority) and at the same time, it may request the resource manager 220 for the resource authority corresponding to track resources R2 and R3 which include the track resource required for train T1 itself to run.

The onboard control unit of train T2 '1D' can secure the resource authority corresponding to track resource R1, thereby autonomously controlling that track resource, and can autonomously perform the return of resources completely used by train T2 '1D' for running.

As shown in FIG. 15, for the purpose of releasing track resource R3 that train T1 '1C' used and securing a new track resource R5, train T1 '1C' may request the resource manager 220 for a new resource authority for releasing track resources R3 and R4, and at the same time, securing track resources R4 and R5.

For the purpose of newly requesting track resource R3 that preceding train T1 '1C' has released while releasing track resource R1 that train T2 '1D' completely used, trailing train T2 '1D' may request the resource manager 220 for a new resource authority for releasing track resources R1 and R2 and securing track resources R2 and R3.

Figure 16:
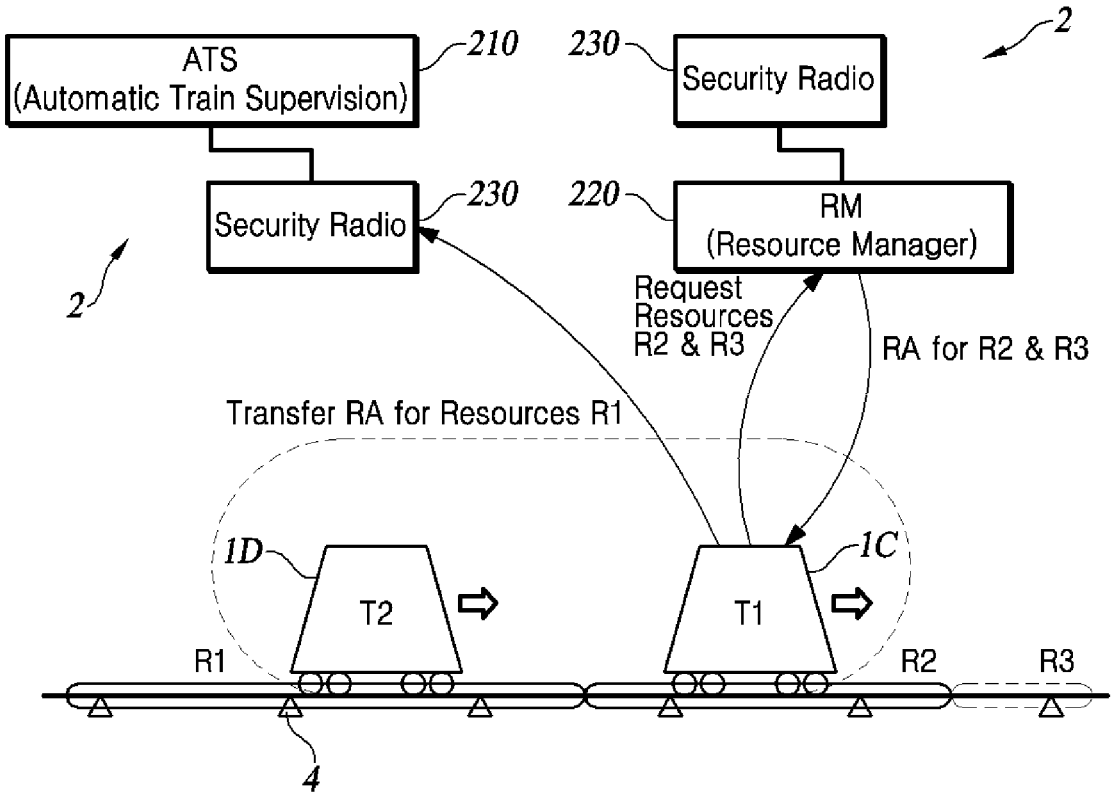
FIG. 16 illustrates a response to a failure situation of an onboard control unit of a trailing train of two trains when intercoupled according to at least one embodiment of the present disclosure.

FIG. 16 illustrates a response to a failure situation of an onboard control unit of a trailing train of two trains when intercoupled according to at least one embodiment of the present disclosure.

Even when two intercoupled trains have a train or an onboard control unit failed, the track resources owned by the intercoupled trains need to be managed so as not to disturb the operation of the trains.

For example, one needs to transport a disabled train to the evacuation site safely and release the resources already occupied by the disabled train for allowing normal trains to run on.

As shown in FIG. 16, when a failure occurs in trailing train T2 '1D' between the two intercoupled trains while the onboard control unit of train T2 '1D' is in normal working condition, disabled train T2 '1D' abruptly increases the interval between the two intercoupled trains. As a result, the virtually connected trains can be perceived to have lost the train integrity. At this time, the two trains can be protected by engaging in emergency braking.

Preceding train T1 '1C' may confirm that train T2 '1D' has failed through communication with the onboard control unit of train T2 '1D', and thereby it can recognize that the two trains cannot run normally in tandem.

At this time, train T1 '1C' may have a normal separation procedure with train T2 '1D'. As shown in FIG. 15, train T1 '1C' may transfer the resource authority corresponding to the track resources seized by train T2 '1D' to train T2 '1D', and render the resource manager 220 to renew resources after excluding train T2 '1D' from the combined length of train T1 '1C'.

The ATS unit 210 can also check the failure state of train T2 '1D' through the periodic status report of the onboard control unit, and reclaims the resource authority owned by the onboard control unit of train T2 '1D' and at the same time, take measures to safely evacuate train T2 '1D'.

When the onboard control of train T2 '1D' is failed, the two trains can engage in emergency braking. The onboard control unit of train T1 '1C' may confirm the failure state of train T2 '1D' through the loss of communication with the onboard control unit of train T2 '1D'.

The onboard control unit of train T1 '1C' may recognize that the normal coupling is impossible with train T2 '1D' and may attempt a separation procedure.

Since the onboard control unit of train T1 '1C' cannot transfer the resource authority corresponding to the track resources seized by train T2 '1D' to the onboard control unit of train T2 '1D', it may transfer those track resource to the ATS unit.

Figure 17:
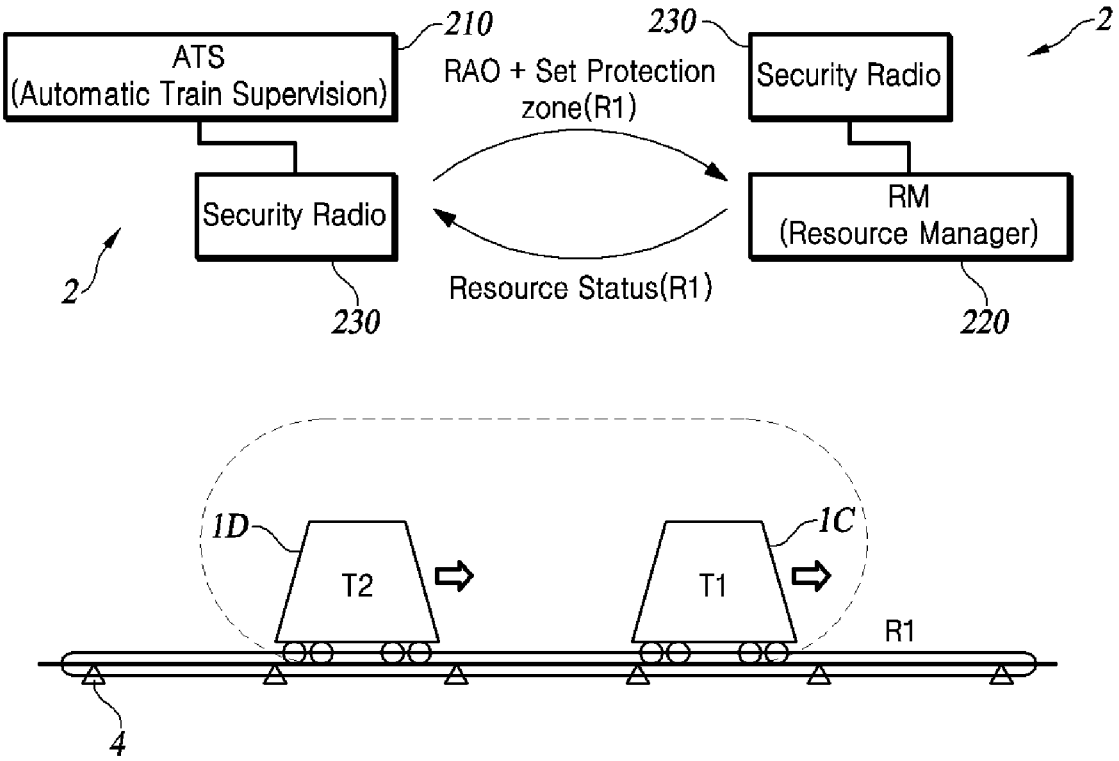
FIG. 17 illustrates a response to a failure situation of an onboard control unit of a preceding train of two trains when intercoupled according to at least one embodiment of the present disclosure.

FIG. 17 illustrates a response to a failure situation of an onboard control unit of a preceding train of two trains when intercoupled according to at least one embodiment of the present disclosure.

As shown in FIG. 17, when a failure occurs in preceding train T1 '1C' between the two intercoupled trains while the onboard control unit of train T1 '1C' is in normal working condition, the two trains can engage in emergency braking to make a normal safe stop.

The onboard control unit of train T1 '1C' may release the connection with train T2 '1D', as shown in FIG. 15, when normal driving tandem is not possible due to a failure of train T1 '1C'.

Thereafter, the ATS unit 210 may check the failure state of train T1 '1C' through the periodic status report of the onboard control unit, and reclaim the resource authority owned by the onboard control unit of train T1 '1C', and at the same time, take measures to safely evacuate train T1 '1C'.

When a failure occurs in the onboard control unit of preceding train T1 '1C' between the two trains, the two can be protected by engaging emergency braking. The onboard control unit of train T1 '1C' owns the resource authority when it fails, which may need the ATS unit 210 to intervene.

The ATS unit 210 may set the zone seized by train T1 '1C' as a protection zone by using a special resource authority to prevent the entry of other trains, and at the same time, take measures to safely evacuate disabled train T1 '1C'.

The ATS unit 210 may release the connection between the two trains so that train T2 '1D', which is a trailing train, may operate normally, and train T2 '1D' may switch to a state in which it can operate alone.

Figure 18:
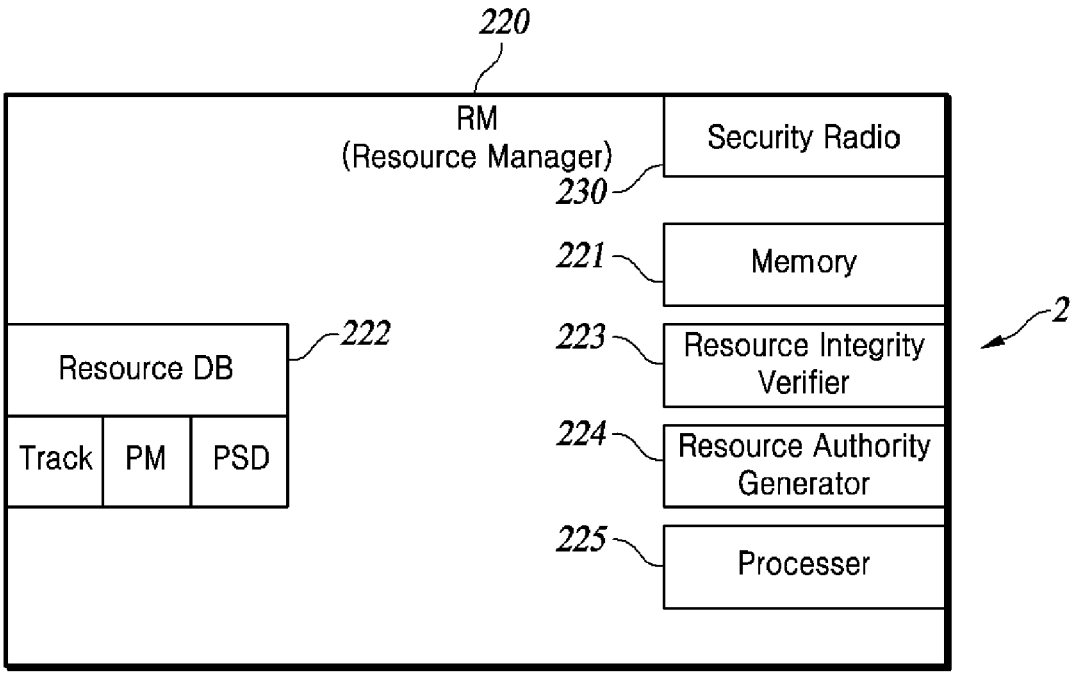
FIG. 18 is a block diagram of a configuration of a resource manager according to at least one embodiment of the present disclosure.

FIG. 18 is a block diagram of a configuration of a resource manager according to at least one embodiment of the present disclosure.

As shown in FIG. 18, the resource manager 220 may include a memory 221, a track resource DB 222, a resource integrity verifier 223, a resource authority generator 224, and a processor 225.

The resource manager 220 is a vital device, and when a failure occurs disabling normal operation of the route, the resource manager 220 is preferably configured in at least a redundancy or dual system.

The resource manager 220 has a security radio unit 230 which provides communications between the ATS unit 210 and the onboard control unit 110 of the train 1 as well as communications for the resource integrity verification between the ATS unit 210 and the OC 310 linked with the track resources.

The memory 221 may record ownership status information of the track resources and may write a track resource zone in which resource integrity is suspected to be compromised.

In addition, the memory 221 may write the protection zone and the temporary speed limit zone received from the ATS unit 210, the temporary speed limit zone received from the train, and the like.

The resource manager 220 has a database of track resources of all tracks, PMs, and PSDs of a route, and may configure the track resource DB 222 in the form of a coordinate system centered on the wayside coils. The track resource DB 222 may include location information for each track resource, and the range of each track resource may be expressed by a starting point and an endpoint from the wayside coil.

The resource integrity verifier 223 may monitor resource integrity through periodic communications with the OC 310. In this case, the OC 310 may include a separate device capable of verifying the integrity of a specific track resource such as a PM or PSD and the track integrity of a specific track zone.

The resource authority generator 224 may be configured to be responsive to a track resource request or an update request from the track resource owner for generating a resource authority corresponding to the relevant track resource, that is, a unique key.

The unique key value needs to be long enough so that it is neither duplicative of other unique key values nor reused. In addition, the unique key is preferably generated by applying a one-way function such as a hash function so that the unique key value cannot be inferred through the relevant track resource or owner.

The processor 225 may be configured to check the validity of a request received from the resource owner for such tasks as securing, releasing, controlling, and updating the track resources.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

The invention claimed is:

1. A system for exclusive track resource sharing, comprising:

a plurality of onboard control units comprising an onboard control unit that is provided in each of a plurality of trains and configured to communicate with another onboard control unit in another one of the plurality of trains; and a resource manager configured to:

record ownership status information about track resources of the plurality of trains, to provide the ownership status information about the track resources to the onboard control unit;

generate and deliver a resource authority to the onboard control unit;

receive from the onboard control unit at least one request for securing, releasing, controlling, or updating the resource authority; and determine validity of the at least one request, wherein the resource authority is configured to be owned by a single onboard control unit, and wherein the onboard control unit possessing the resource authority is configured to seize or release the track resources corresponding to the resource authority and to control the track resources corresponding to the resource authority, wherein the system further comprises an object controller (OC) configured to control a track resource corresponding to the resource authority based on control by the onboard control unit possessing the resource authority, wherein the ownership status information indicates which of the plurality of trains have ownership of the track resources.

2. The system of claim 1, wherein the plurality of onboard control units comprise a first onboard control unit provided in a first train and a second onboard control unit provided in a second train, the first onboard control unit is configured to transfer a first resource authority that is owned by the first onboard control unit to the second onboard control unit, and the second onboard control unit having received the first resource authority is configured to seize or release the track resources corresponding to the first resource authority.

3. The system of claim 1, wherein the track resources comprise at least one of a track, a point machine (PM), and a platform screen door (PSD).

4. The system of claim 3, wherein the OC is configured to control a first point machine (PM) or a first platform screen door (PSD) corresponding to the resource authority, wherein the onboard control unit is configured to, while the resource authority is owned by the onboard control unit, transmit a control command to the resource manager for switching the first PM to a nominal position or a reverse position, or for switching the first PSD to an open state or a closed state, the resource manager is configured to transmit a control command to the OC for switching the first PM to the nominal position or the reverse position, or for switching the first PSD to the open state or the closed state based on the control command received from the onboard control unit, and the OC is configured to switch the first PM to the nominal position or the reverse position or switch the first PSD to the open state or the closed state based on the control command received from the resource manager.

5. The system of claim 3, wherein the OC is configured to control a first point machine (PM) or a first platform screen door (PSD) corresponding to the resource authority, wherein the onboard control unit is configured to, while the resource authority is owned by the onboard control unit, transmit a control command to the OC for switching the first PM to a nominal position or a reverse position, or for switching the first PSD to an open state or a closed state, and the OC is configured to switch the first PM to the nominal position or the reverse position or switch the first PSD to the open state or the closed state based on the control command received from the onboard control unit.

6. The system of claim 5, wherein the resource manager is configured to update a resource authority corresponding to the first PM or the first PSD, and to transmit to the OC an updated resource authority corresponding to the first PM or the first PSD.

7. The system of claim 1, wherein the resource manager is configured to monitor whether the track resources are defective, and to be responsive to a defect in the track resources for converting defective track resources into an unallocatable state.

8. The system of claim 1, wherein the onboard control unit is configured to request the resource manager for ownership status information about track resources of a scheduled travel zone having a predetermined length in front of a subject train, to calculate track resources to be secured by the subject train based on the ownership status information about track resources of the scheduled travel zone received from the resource manager, and to request the resource manager for a resource authority corresponding to the track resources to be secured by the subject train.

9. The system of claim 8, wherein the resource manager is configured to be responsive to another onboard control unit in another train seizing at least some of the track resources of the scheduled travel zone, for which the onboard control unit has made a request, for providing the onboard control unit with a resource authority corresponding to the track resources except for a track resource area within the track resources of the scheduled travel zone, for which the onboard control unit has made the request, or for rejecting the request for the track resources of the scheduled travel zone.

10. The system of claim 8, wherein the onboard control unit is configured to request the resource manager to release the track resources used by the subject train by using a resource authority owned by the onboard control unit, and at the same time, to request a resource authority corresponding to the track resources required for the subject train to run.

11. The system of claim 1, wherein the resource authority is generated through a one-way function.

12. The system of claim 1, further comprising an automatic train supervision (ATS) unit configured to possess a special resource authority to seize or release all track resources, wherein the ATS unit is configured to control all track resources by using the special resource authority.

13. A system for exclusive track resource sharing, comprising:

a plurality of onboard control units comprising an onboard control unit that is provided in each of a plurality of trains and configured to communicate with another onboard control unit in another one of the plurality of trains; and a resource manager configured to record ownership status information about track resources of the plurality of trains, to provide the ownership status information about the track resources to the onboard control unit, and to generate and deliver a resource authority to the onboard control unit, wherein the resource authority is configured to be owned by a single onboard control unit, wherein the onboard control unit possessing the resource authority is configured to seize or release the track resources corresponding to the resource authority and to control the track resources corresponding to the resource authority, and wherein the resource manager comprises:

a memory configured to record one or more of ownership status information, a protection zone, and a temporary speed limit zone for the track resource;

a track resource database (DB) including location information for each track resource;

a resource integrity verifier configured to monitor each track resource for abnormalities;

a resource authority generator configured to generate a resource authority corresponding to each track resource; and a processor configured to determine a request validity for at least one request for securing, releasing, controlling and updating each resource authority received from the onboard control unit.

14. A system for exclusive track resource sharing, comprising:

a plurality of onboard control units comprising an onboard control unit that is provided in each of a plurality of trains and configured to communicate with another onboard control unit in another one of the plurality of trains; and a resource manager configured to record ownership status information about track resources of the plurality of trains, to provide the ownership status information about the track resources to the onboard control unit, and to generate and deliver a resource authority to the onboard control unit, wherein the resource authority is configured to be owned by a single onboard control unit, and wherein the onboard control unit possessing the resource authority is configured to seize or release the track resources corresponding to the resource authority and to control the track resources corresponding to the resource authority, wherein the system further comprises a twin point machine (PM) including a first PM provided in a first track and a second PM provided in a second track adjacent to the first track, the first PM and the second PM each being configured to have a resource authority corresponding to each of the first PM and the second PM, and wherein the onboard control unit is configured to control the first PM upon a grant of the resource authority corresponding to the first PM, and to control the second PM upon a grant of the resource authority corresponding to the second PM.

15. A system for exclusive track resource sharing, comprising:

a plurality of onboard control units comprising an onboard control unit that is provided in each of a plurality of trains and configured to communicate with another onboard control unit in another one of the plurality of trains; and a resource manager configured to record ownership status information about track resources of the plurality of trains, to provide the ownership status information about the track resources to the onboard control unit, and to generate and deliver a resource authority to the onboard control unit, wherein the resource authority is configured to be owned by a single onboard control unit, wherein the onboard control unit possessing the resource authority is configured to seize or release the track resources corresponding to the resource authority and to control the track resources corresponding to the resource authority, wherein the plurality of onboard control units comprises a first onboard control unit provided in a first train and a second onboard control unit provided in a second train following the first train, wherein the second onboard control unit is configured to transfer a resource authority owned by the second onboard control unit to the first onboard control unit when the first train and the second train are coupled to each other, and wherein:

the first onboard control unit is configured to recognize the length of the first train as including a rear portion of the second train, or the first onboard control unit is configured to be responsive to the first train and the second train when coupled to each other for releasing track resources used by the first train and the second train through the resource manager and requesting the resource manager for resource authorities corresponding to the track resources required for the second train to run.

16. The system of claim 15, wherein the first onboard control unit is configured to recognize the length of the first train as including the rear portion of the second train.

17. The system of claim 15, wherein the first onboard control unit is configured to be responsive to the first train and the second train when coupled to each other for releasing the track resources used by the first train and the second train through the resource manager and requesting the resource manager for the resource authorities corresponding to the track resources required for the second train to run.

18. The system of claim 17, wherein the first onboard control unit is configured to be responsive to the first train and the second train when separated from each other for transferring a resource authority corresponding to the track resources required for the second train to run, and upon separation of the first train and the second train, the first onboard control unit is configured to release the track resources used by the first train through the resource manager and to request the resource manager for a resource authority corresponding to the track resources required for the first train to run, and the second onboard control unit is configured to release the track resources used by the second train through the resource manager and to request the resource manager for a resource authority corresponding to the track resources required for the second train to run.

19. A system for exclusive track resource sharing, comprising:

a plurality of onboard control units comprising an onboard control unit that is provided in each of a plurality of trains and configured to communicate with another onboard control unit in another one of the plurality of trains; and a resource manager configured to record ownership status information about track resources of the plurality of trains, to provide the ownership status information about the track resources to the onboard control unit, and to generate and deliver a resource authority to the onboard control unit, wherein the resource authority is configured to be owned by a single onboard control unit, wherein the onboard control unit possessing the resource authority is configured to seize or release the track resources corresponding to the resource authority and to control the track resources corresponding to the resource authority, wherein the system further comprises an automatic train supervision (ATS) unit configured to possess a special resource authority to seize or release all track resources, and control all track resources by using the special resource authority, and wherein:

the onboard control unit and the ATS unit are configured to set or release a temporary speed limit zone on a track owned by the onboard control unit, and the ATS unit is configured to set or release a protection zone on the track owned by the onboard control unit, the ATS unit is configured to release or control track resources owned by one of the plurality of onboard control units provided in one of plurality of trains by using the special resource authority when a failure occurs in the one of the plurality of trains, or the ATS unit is configured to request the one of the plurality of onboard control units provided in the one of plurality of trains to transfer a resource authority owned by the one of the plurality of trains to the ATS unit when a failure occurs in the one of the plurality of trains.

20. The system of claim 19, wherein the onboard control unit and the ATS unit are configured to set or release the temporary speed limit zone on the track owned by the onboard control unit, and the ATS unit is configured to set or release the protection zone on the track owned by the onboard control unit.

21. The system of claim 19, wherein the ATS unit is configured to release or control track resources owned by the one of the plurality of onboard control units provided in the one of the plurality of trains by using the special resource authority when the failure occurs in the one of the plurality of trains.

22. The system of claim 19, wherein the ATS unit is configured to request the one of the plurality of onboard control units provided in the one of the plurality of trains to transfer a resource authority owned by the one of the plurality of onboard control units to the ATS unit when the failure occurs in the one of the plurality of trains.

* * * * *